US007530537B2

(12) United States Patent
Kandah

(10) Patent No.: US 7,530,537 B2
(45) Date of Patent: May 12, 2009

(54) CABINET DOOR MOUNTED GROCERY BAG HOLDER

(76) Inventor: Hanna F. Kandah, 10449 Spring Grove, Brighton, MI (US) 48114

( * ) Notice: Subject to any disclaimer, the term of this patent is extended or adjusted under 35 U.S.C. 154(b) by 0 days.

(21) Appl. No.: 11/901,896

(22) Filed: Sep. 19, 2007

(65) Prior Publication Data

US 2008/0128565 A1 Jun. 5, 2008

Related U.S. Application Data

(63) Continuation-in-part of application No. 11/442,783, filed on May 30, 2006, now abandoned.

(51) Int. Cl.
*B65B 67/04* (2006.01)

(52) U.S. Cl. ..... 248/99; 248/100; 248/95; 248/301; 220/482; 383/33

(58) Field of Classification Search ..... 248/95, 248/100, 101, 301, 99, 300; 220/482, 480; 383/33

See application file for complete search history.

(56) References Cited

U.S. PATENT DOCUMENTS

| | | | | | |
|---|---|---|---|---|---|
| 2,903,215 | A | * | 9/1959 | Metcalf | 248/99 |
| 3,684,225 | A | * | 8/1972 | Crawford et al. | 248/99 |
| 3,779,496 | A | * | 12/1973 | Welles | 248/99 |
| 4,620,319 | A | * | 10/1986 | Sheehan et al. | 383/33 |
| 4,669,689 | A | * | 6/1987 | Jones | 248/99 |
| 4,695,020 | A | * | 9/1987 | Collins | 248/100 |
| 4,923,235 | A | * | 5/1990 | Stewart | 294/141 |
| 5,029,926 | A | * | 7/1991 | Dieterich, Jr. | 294/171 |
| 5,160,103 | A | * | 11/1992 | Breitenstein | 248/100 |
| 5,222,702 | A | * | 6/1993 | Olmos | 248/95 |
| 6,098,933 | A | * | 8/2000 | Stein | 248/99 |
| 6,152,408 | A | * | 11/2000 | O'Grady | 248/100 |
| 6,488,241 | B1 | * | 12/2002 | Kyte et al. | 248/95 |
| D471,082 | S | * | 3/2003 | Scola | D8/373 |
| D480,295 | S | * | 10/2003 | Scola | D8/373 |
| 6,726,156 | B1 | * | 4/2004 | Scola | 248/95 |

* cited by examiner

*Primary Examiner*—Kimberly T Wood
(74) *Attorney, Agent, or Firm*—The Weintraub Group, PLC

(57) ABSTRACT

A holder for holding a plastic shopping/grocery bag open includes a bracket joined to U-shaped frame formed by a base and a pair of coplanar bag support arms, the frame forming an outwardly open U-shaped space to receive and hold the bag by the handles at the openable end of the bag and suspend and maintain the mouth of the bag in an upwardly open position. The bracket is designed for mounting the holder atop a kitchen cabinet door or held by hand. Each support arm includes two axially spaced slots that open outwardly and away from the U-shaped space to hold a respective looped handle of the bag. Reinforcing rib structure operates to resist flexure between the arms, bracket, and base. In use, the looped handles of the bag are secured into the slots and the bag suspended from the extensions and held open by its looped handles being secured into slots of the extensions.

9 Claims, 4 Drawing Sheets

FIG 1
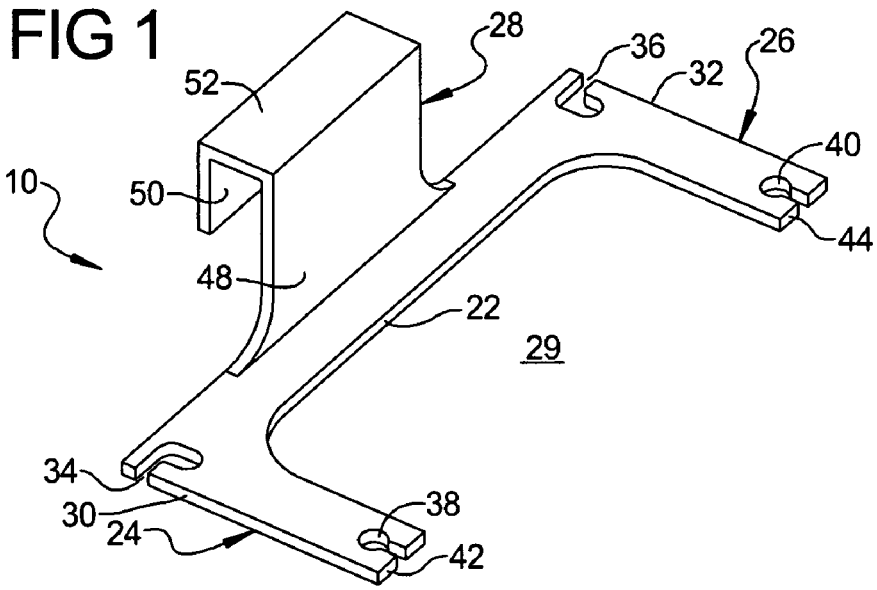
FIG 2A
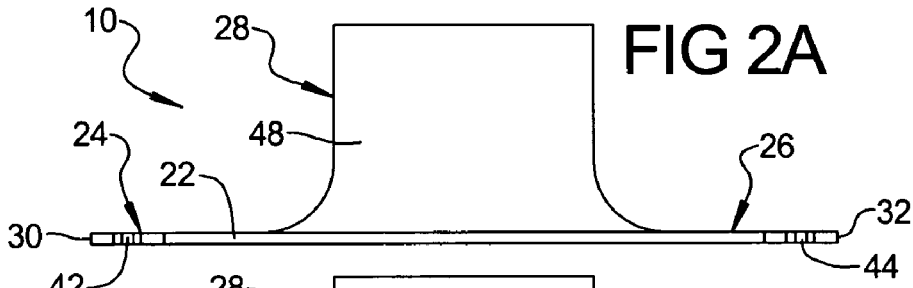
FIG 2B
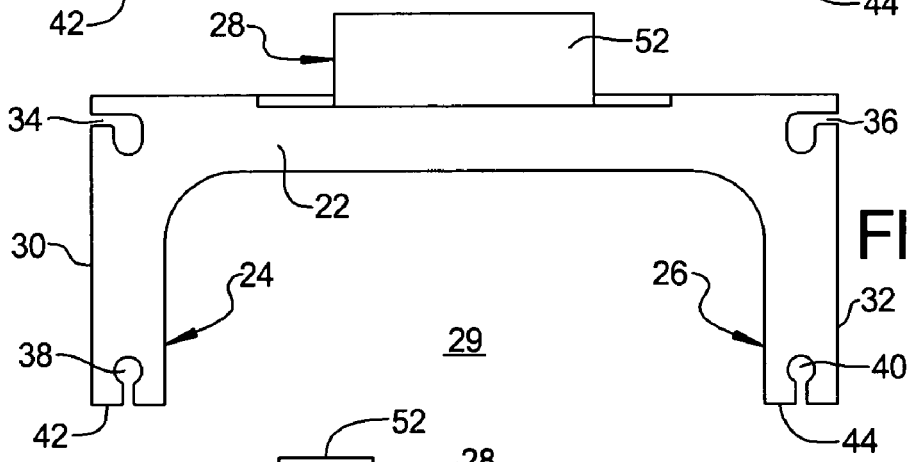
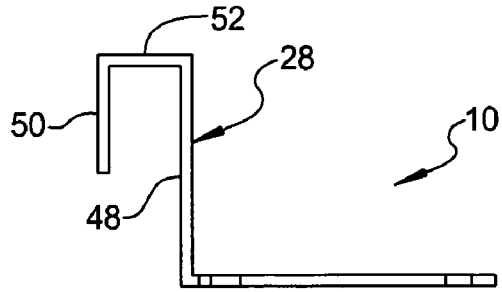
FIG 2C

FIG 3
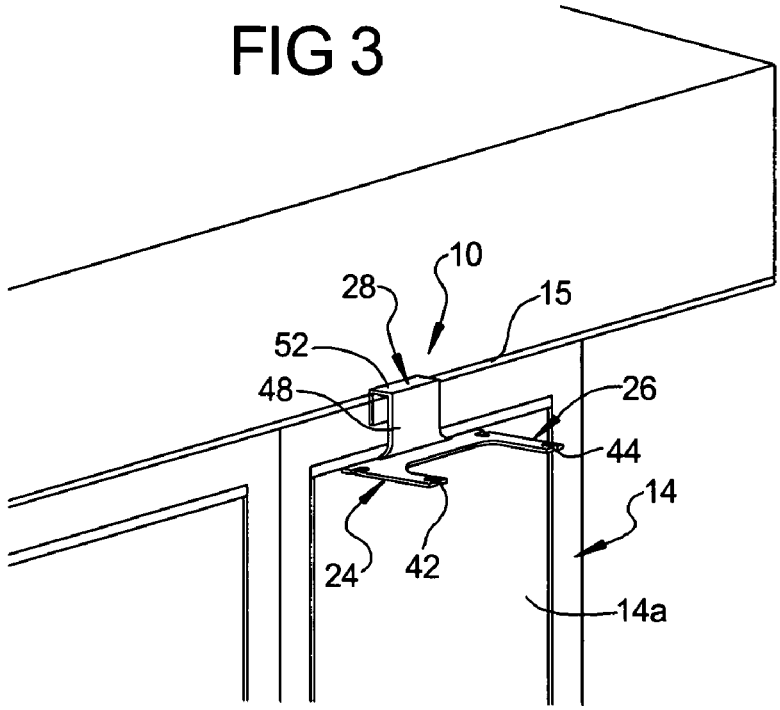
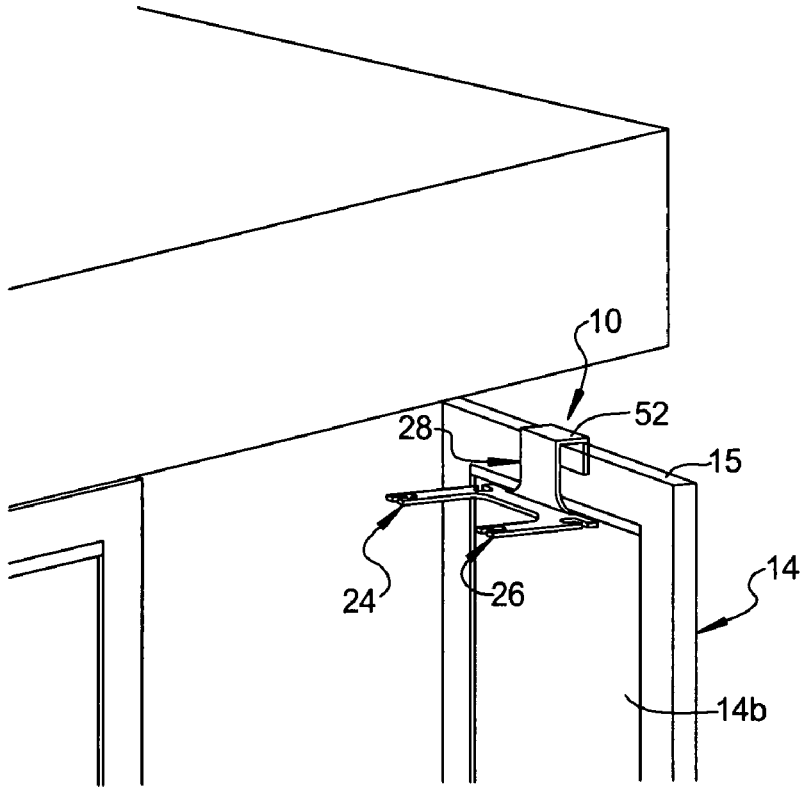
FIG 4

FIG 7
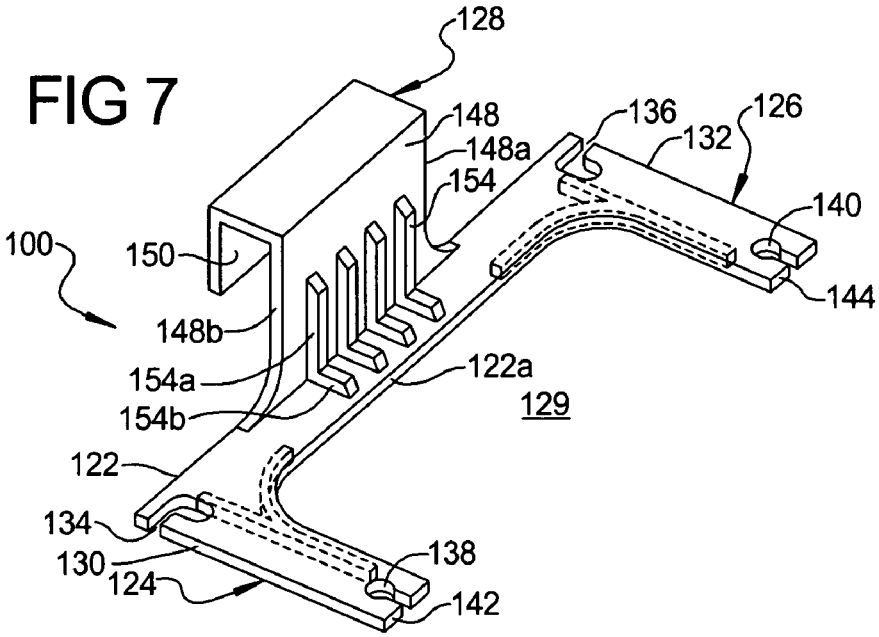
FIG 9
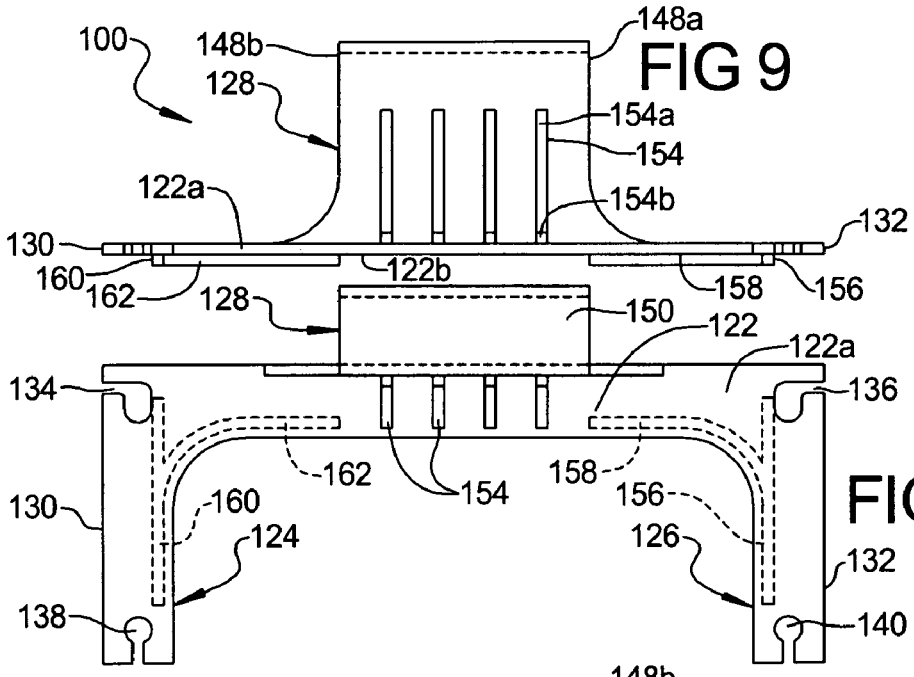
FIG 10
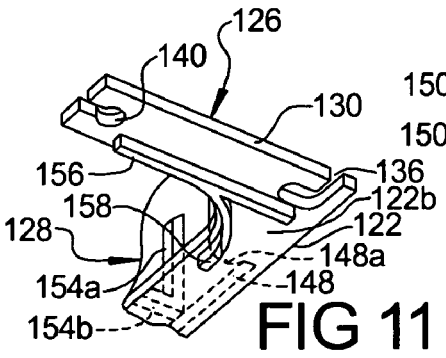
FIG 11
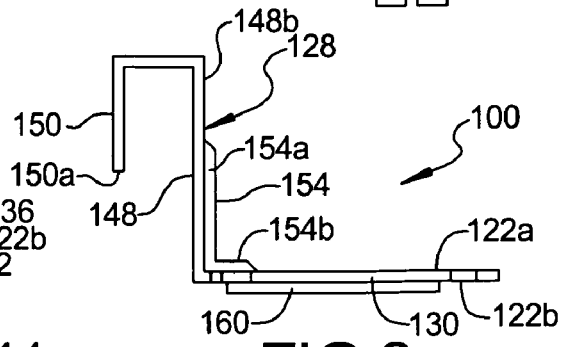
FIG 8

CABINET DOOR MOUNTED GROCERY BAG HOLDER

CROSS-REFERENCE TO RELATED APPLICATION

This application is a Continuation-In-Part application of parent U.S. patent application Ser. No. 11/442,783, filed May 30, 2006, now abandoned in which originally filed parent Application the Specification was replaced by a Substitute Specification to obviate informality defects in the drawings and Specification, the entire disclosures of which are hereby incorporated by reference.

BACKGROUND OF THE INVENTION

1. Field of the Invention

This invention relates generally to the field of bag holders, and more specifically to the cabinet door mounted holders.

2. Description of the Prior Art

Cabinet mounted trash bag holding devices or other similar holders have been proposed in various United States Patents. Illustrative arrangements are disclosed in the following U.S. Pat. No. 4,498,652, Malik, February, 1985; U.S. Pat. No. 4,669,689, Jones, June, 1987; U.S. Pat. No. 4,738,478, April, 1988; U.S. Pat. No. 4,750,695, Greenhouse, June, 1998; U.S. Pat. No. 5,085,385, Breitenstein, February, 1992; U.S. Pat. No. 5,139,219, Navarro, August, 1992; U.S. Pat. No. 5,154,378, Plum, October, 1992; U.S. Pat. No. 5,163,645, Caruso, November, 1992; U.S. Pat. No. 5,836,553, Bergaila, November, 1998; U.S. Pat. No. 6,296,212, Monahan, October, 2001; U.S. Pat. No. 6,557,716, Chan, May, 1992; U.S. Pat. No. 6,604,717, Stanfield, August, 29003; U.S. Pat. No. 6,488,241, Kyte, December, 2002; D326752, Griggs, June, 1992; and D510166, Kitchens, April, 2001.

The arrangements of the above prior art patents are listed in recognition of the duty of disclosure of related subject matter, which may be relevant under 37 CFR 1.56.

The arrangements in the above-referenced documents are designed to hold open trash bags for trash collection. However, they target the use of trash bags and fail to efficiently utilize plastic shopping/grocery bags with integral handles dispensed freely to the consumer when buying groceries or shopping at discount stores and other shopping outlets. In addition, many utilize hardware attachments to mount the device on the inside of cabinet doors.

As consumers continue to acquire plastic shopping bags, provided freely with other item purchases from discount or grocery stores, there arises a need to usefully utilize these bags by the consumers.

This bag holder allows the consumer to utilize unused plastic shopping/grocery bags for depositing and collection household trash before disposing into large trash containers. The advantage this invention provides is the simplicity of use while providing savings to the consumer by reducing the need for store purchased trash bags.

This invention has advantages over referenced patents in that it can be freely mounted to the outside of the cabinet door, to the inside of the cabinet door, or can be carried by hand while supporting open plastic shopping/grocery bags looped through the handles and used for household trash collections, or for outdoor collections of objectionable matter such as animal feces.

BRIEF SUMMARY OF THE INVENTION

The present invention provides a bag holder to keep open a plastic shopping/grocery bag provided with integral looped handles, the holder being freely hung over the top of a kitchen-under-counter-cabinet door for depositing trash produced in the kitchen or held by hand and used for depositing animal feces collected from yards by pet owners.

The bag holder of the present invention comprises a U-shaped bracket or handle configured for hanging on top of cabinet doors or held by hand, and a base formed at right angles to the handle and provided with two mirror image extensions or arms designed with specially oriented and configured holding slots for attaching to the bag loops and laterally spaced from one another a suitable distance to form an outwardly open U-shaped space for nesting, supporting and holding open the mouth of the attached plastic shopping/grocery bag when the two loop handles on the bag are engaged and retained by the holding slots, the U-shaped space providing a sufficient opening for users to deposit household produced trash into the bag.

The base and extension arms are integrally formed to form a U-shaped frame, generally coplanar, adapted to be parallel to the ground when in use, and the holding slots on each arm are oriented to open outwardly and face away from the U-shaped space for nesting the mouth of the bag. The holding slots include a rearward L-shaped slot and a forward keyhole shaped slot.

Preferably, an array of first stiffening ribs operate between the base and the handle/bracket to resist flexure and maintain a right angled relation therebetween and a second stiffening rib operates between the base and each extension arm to resist deflection of the bag holding arm due to the weight of the grocery bag. In a preferred embodiment, the first stiffening ribs are L-shaped and the second stiffening ribs are Y-shaped and each includes interconnected first and second rib members, the first rib member extending axially through the arm and between the rearward and forward holding slots thereof and the second rib member extending transversely of the rearward holding slot thereof and terminating proximate to the holding bracket.

BRIEF DESCRIPTION OF THE DRAWINGS

The drawings constitute a part of the specification for this invention and will become more fully apparent as this description proceeds with greater detail as referenced in the accompanying embodiments.

FIG. 1 is an isometric view of a bag holder according to the invention, the bag holder including a handle, a base and two extensions with holding slots.

FIGS. 2A, 2B, and 2C, respectively, are a front elevation, a top plan view looking down, and a side elevation view of the bag holder shown in FIG. 1.

FIGS. 3 and 4 are perspective views of the bag holder hanging on the front and the inside of a cabinet door respectively.

FIG. 7 is a perspective view of another preferred embodiment of a bag holder, according to this invention, the bag holder including a handle and/or mounting bracket, and a base provided with two extension arms, each provided with a pair of axially spaced bag loop holding slots, and reinforcing structure operating between the base and the bracket and between the base and the extension arms.

FIGS. 8-10 are side, front, and plan view of the bag holder of FIG. 7.

FIG. 11 is a perspective view showing reinforcing rib structure formed on the bottom surface of an extension arm and the base, the other extension arm being the mirror image thereof.

DETAILED DESCRIPTION OF THE INVENTION

Figure 5:
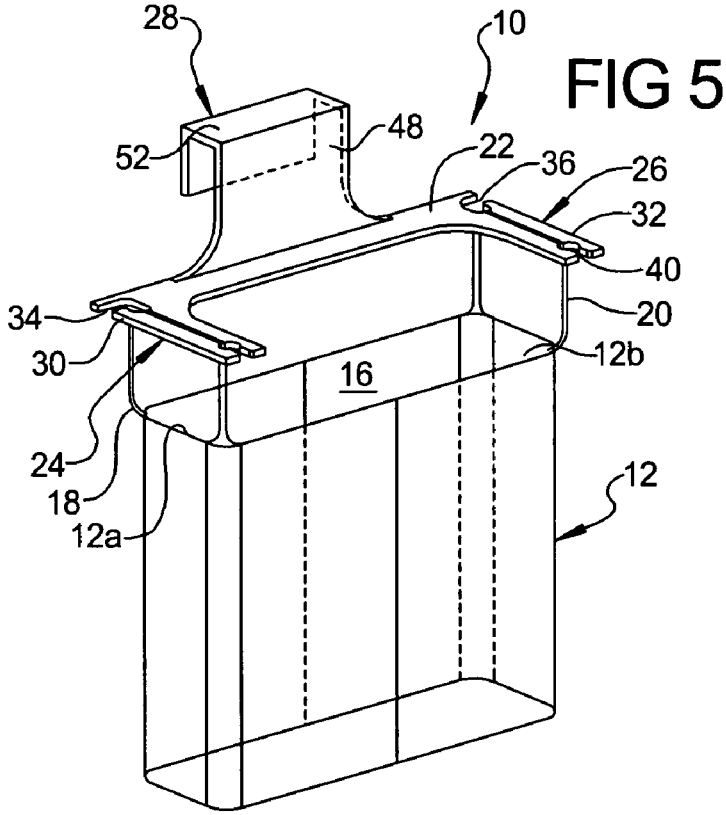
FIG. 5 is a perspective view of the holder with the opposed handles of a plastic shopping/grocery bag looped through holding slots in the extension arms of the bag holder.

Referring now to the drawings, FIGS. 1 and 2 illustrate a bag holder according to this invention, generally indicated by the reference number 10. The bag holder 10 is intended to hang a conventional plastic bag (see FIGS. 5 and 6), generally indicated by the reference numeral 12, atop a standard door, generally indicated by the reference numeral 14. As contemplated, the bag 12 is the type of shopping and/or grocery bag conventionally used by stores to enable shoppers to carry purchased items. Such plastic bags are limp, lightweight but strong, and easily openable.

Figure 6:
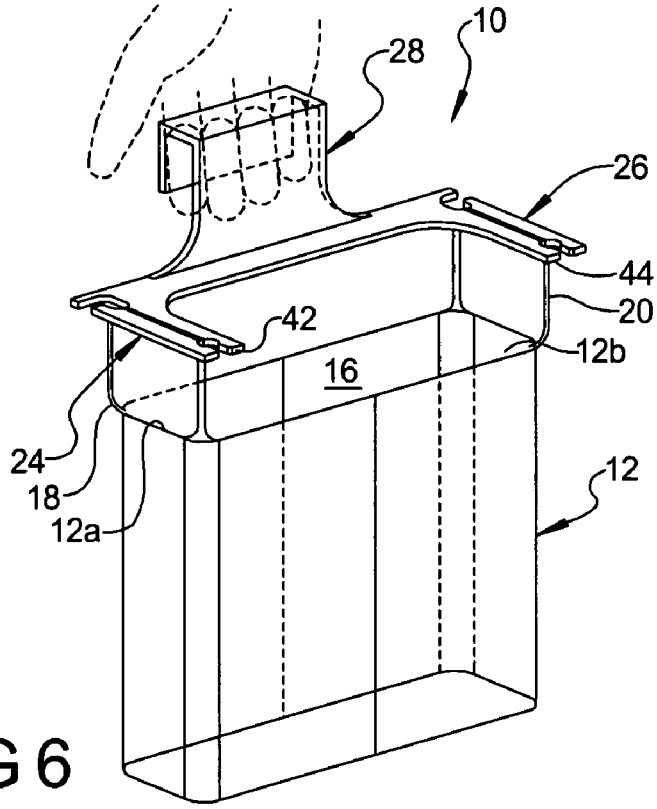
FIG. 6 is a perspective view of the holder being held for the purpose of collecting animal feces or outdoor trash.

As shown best in FIGS. 5 and 6, the plastic bag 12 has an upper edge 12*a* provided with two looped handles 18 and 20. The bag is upwardly openable to form an opening 12*b* leading to a receptacle 16.

The bag holder 10 is comprised of a one-piece design including a base 22 having two extensions or beams 24 and 26 and a hanging handle 28 formed onto the base and perpendicular to the two extensions. The base 22 and extensions 24 and 26 are generally coplanar with one another with the extensions 22 and 24 being laterally separated (i.e., spaced apart) a distance sufficient to form with the base 22 a U-shaped space 29 for positioning and supporting the openable end portion of the bag in an upwardly open position.

Each bag support arm or extension 24 and 26 has, respectively, a lateral side 30 and 32, a rearward slot or hook 34 and 36 formed in the lateral side 30 and 32 proximate to the handle 28, and a forward slot or hook 38 and 40 formed in a distal end 42 and 44. The rearward slots 34 and 36 form an L-shaped hook. The forward slots 38 and 40 form a keyhole shape. The handles or loops 18 and 20 are received in the respective sets of slots or hooks, whereupon the extensions 24 and 26 hold the upper end of the bag in an open position and the lower end of the bag hangs vertically downwardly.

The attachment of the bag 12 to the bag holder 10 is illustrated in FIGS. 5 and 6, wherein the looped handle 18 is received in the rearward and forward slots 34 and 38 of the bag support arm or extension 24, and the looped handle 20 is received in the rearward and forward slots 36 and 40 of the bag support arm or extension 26. The slots in the extension are designed for easy insertion and removal of the integral looped handles 18 and 20 supplied with the plastic shopping/grocery bags.

The keyhole shaped slots or hooks 38 and 40 have a narrowed inlet at the forward or distal end 42 and 44 of the respective extension 24 and 26 to permit easy axial insertion of the bag handle 18 and 20 into an enlarged rearward chamber of the slot, and captivation therein.

The L-shaped slots or hooks 34 and 36 open on the oppositely facing lateral sides 30 and 32 of the extensions 24 and 26. These L-shaped slots are at the rearward end of the extension, proximate to the base member 22, and include a first portion that is transverse to the keyhole slot at the forward end of the extension, and a second portion that extends forwardly. The L-shaped slots or hooks 34 and 36 allow easy installation and inhibit unwanted withdrawal of the bag handles therefrom.

The hanging handle 28 comprises an inverted squared U-shaped cradle formed by a generally planar first plate 48, attached to and disposed at a right angle to the base 22 and associated bag supports or extensions 24 and 26, a second plate 50, parallel and spaced from the plate 48, and an intermediate plate 52 The handle 28 is adapted to sit atop the top lateral surface 15 of the door 14 in a manner that the plates 48 and 50 are juxtaposed with the interior and exterior surfaces 14*a* and 14*b* of the door 14 and the intermediate plate 52 seats atop the door.

FIGS. 3 and 4 illustrate the dual hanging capability of the bag holder 10. Referring to FIG. 3, the handle or bracket 12 of the bag holder 10 is shown freely hanging from the top of an under-kitchen-counter-cabinet door with the bag facing the outer side 14*a* of the cabinet door.

Referring to FIG. 4, the cradle positions the bag 12 to face the inside surface 14*b* of the cabinet door. When the cabinet door 14 is closed, the bag holder 10 and the bag 12 suspended therefrom are hidden and out of view.

When the bag holder 10 is mounted atop the door 14, the base and associated bag supports 24 and 26 are substantially perpendicular to the vertical surfaces 14*a* and 14*b* of the door and disposed in a horizontal plane. In this regard, the plate 48 is supported against a vertical surface of the door, depending on whether the holder is intended for interior or exterior placement relative to the under the cabinet door.

Referring to FIG. 5, a preferred embodiment of the manner and use of the present invention bag holder 10 is illustrated. A person will attach the handles 18 and 20 of the grocery/shopping bag onto the extension arms 24 and 26 without the use of a tie or other holding aids by inserting the handle 18 into the rearward and forward slots 34 and 38 of the bag support arm or extension 24 and the handle 20 into the slots 36 and 40 of the bag support arm or extension 26. The extension arms 24 and 26 will provide sufficient tension to keep the mouth of the bag open for trash deposits.

FIG. 6 illustrates the manner in which this invention can be used for picking up animal feces. A person will loop the plastic shopping/grocery bag handles through the slots in the extension arms and use the handle to carry the holder and the open bag.

The open position of the mouth of the bag provides an opportunity for a person to pick up pet feces in one hand and deposit into the bag for later disposal.

While the invention has been described in detail on ways of using the bag holder, the use of the bag holder is not limited to these actions as described by the inventor.

Accordingly, various other uses can be embodied by the user as deemed appropriate and still lie within the scope and spirit of the invention as set forth in the claims.

This invention has advantages over referenced patents in that it can be freely mounted to the outside of the cabinet door, to the inside of the cabinet door, or can be carried by hand while supporting open a plastic shopping/grocery bag looped through the handles and used for household trash collections, or for outdoor collections of animal feces.

Turning to FIGS. 7-11, another embodiment of a shopping/grocery bag holder is shown and indicated by the reference number 100.

The bag holder 100 is for supporting a conventional shopping/grocery bag 12 vertically and the mouth at the upper end in an upwardly open position, in a manner as described hereinabove. As above described, the shopping bag 12 is formed of a limp plastic material, upwardly openable to receive groceries and/or other materials to be transported, and provided with opposite loops 18 and 20 which form handles at opposite sides of the top of the bag, which handles are used for carrying and, in the invention herein, suspending the bag from the bag holder.

The bag holder 100 is preferably unitary, such as molded from a polymer or suitable plastic, and comprises a plate member or base 122 formed to include two arms or extensions 124 and 126 for suspending and holding the bag 12 and positioning the mouth thereof in the open position, and a bracket 128 in the form of an inverted U-shape for mounting over the top of a standard door and/or for gripping and carrying by the hand of a user. The base 122 and the arms 124 and 126 are in generally parallel and in coplanar relation with one another, and form a U-shaped frame that is at right angles to the bracket 128. The arms 124 and 126 are laterally spaced from one another, extend from opposite lateral sides of the base member or plate 122, and in combination with the frame, form a U-shaped space 129 that opens outwardly and away from the bracket 128 for receiving and nesting the bag 12.

The extension arms 124 and 126 are generally flat, axially elongated and each has, respectively, an outer lateral side 130 and 132 and a pair of spaced-apart holding slots that form shaped hooks that attach to a respective loop 18 and 20 of the plastic shopping/grocery bag. The holding slots, as described hereinabove, open outwardly and face away from the U-shaped space 129 and the slots of each respective arm are axially spaced relative to one another. Each respective arm 124 and 126 includes a rearward loop holding hook 134 and 136 that is generally L-shaped, proximate to the rearward edge of the base 122, opens outwardly on a respective side 130 and 132, and is oriented, at least in part, to extend transversely and axially relative to the axis of the respective arm. A forward loop holding hook 138 and 140 that is keyhole shaped forms the forward free end 142 and 144 of the respective arm 124 and 126.

The bag holder 100 is preferably provided with reinforcing structure to inhibit the U-shaped holding bracket 128 from flexing relative to the base member 122 and/or cantilevered extension arms 124 and 126 from flexing relative to the base member 122.

As to the former, the reinforcing structure comprises a series of laterally spaced L-shaped ribs 154 that are side-by-side and operate between the forward plate 148 of the inverted U-shaped bracket 128 and the top surface 123 of the base 122. A pair of like configured vertical and horizontally extending axial legs 154*a* and 154*b* form each L-shaped rib 154. The vertical leg 154*a* projects upwardly from the forward end wall 148 of the bracket 128, rises vertically from the upper surface 122*a* of the base 122, and terminates slightly above a plane including a lower edge 150*a* of the rearward end wall 150 of the U-shaped bracket 128. The horizontal leg 154*b* projects upwardly from the upper surface 122*a* of the base 122, extends horizontally from the end wall 148, and terminates proximate to the U-shaped space 129.

In some applications, the axial legs 154*a* and 154*b* may be insufficient to resist flexure. Accordingly, a one-piece panel or web having the shape of a right-angled triangle may replace the L-shaped rib 154.

As to the latter, the reinforcing structure is similar for each arm 124 and 126 but is the mirror image thereof, and comprises a "Y-shaped" rib arrangement that projects, at least in part, from the bottom surface 122*b* of the base 122 and the respective arms 124 and 126.

Referring to FIG. 11, which illustrates the arm 126, the Y-shaped rib arrangement comprises a first rib member 156 that extends axially between the two holding slots 136 and 140 and a second rib member 158 that branches off from the first rib member 156 and follows the contour of the base plate 122 that forms the space 129, extends in a direction transverse to the axis of the arm 126, and terminates in an end generally aligned with a lateral edge 148*a* of the forward end wall 148 of the bracket.

In a similar fashion, as illustrated in FIGS, 7 and 10, the arm 124 has a first rib member 160 that extends axially between the holding slots 134 and 138, and a second rib member 162 that branches off from the first rib member 160 and follows the contour of the base plate 122, extends in a direction transverse to the axis of the arm 124, and terminates in an end generally aligned with a lateral edge 148*b* of the forward end wall 148.

While particular embodiments of the invention have been shown and described, it will be apparent to those skilled in the art that changes and modifications can be made without departing from the invention in its broader aspects, and therefore, the appended claims are intended to include all such changes and modifications that fall within the spirit and scope of the invention.

What I claim is:

1. A shopping/grocery bag holder, comprising:

an inverted U-shaped mounting bracket having forward and rearward walls, two extensions that allow for suspending a plastic shopping/grocery bag open by the handles, wherein said extensions are generally planar, have upper and lower surfaces and each said extension is provided with two axially spaced attachment slots for holding a respective of the bag handles and positioning a mouth of the bag in an upwardly open position, means for connecting the two extensions to the mounting bracket in a manner that the two extensions form cantilever beams and an outwardly open throat and space between the extensions for receiving the bag inserted therein, said means for connecting including a base plate disposed at a right angle to and extending outwardly and away from said forward wall, and stiffening means for stiffening the connection between the bracket and the base plate, said stiffening means comprising an array of laterally spaced first ribs operating between the upper surface of said base plate and the forward wall of said bracket, and a Y-shaped stiffening rib formed, at least in part, on the lower surface of said base plate and said extension.

2. The shopping/grocery bag holder of claim 1, wherein each said first rib is generally L-shaped and includes first and second legs, respectively, operating between the forward wall of the bracket and the upper surface of the base plate.

3. The shopping/grocery bag holder of claim 1, wherein each said first rib is generally in the form of a right-angled triangular plate having a hypotenuse and first and second sides, the sides of which triangle are connected, respectively, to the forward wall of the bracket and to the upper surface of the base plate.

4. The shopping/grocery bag holder of claim 1, wherein said Y-shaped stiffening rib comprises a first rib member that extends axially between the slots of the extension arm, and a second rib member that extends generally transversely from the first rib member and between the extension and the base plate.

5. A bag holder for supporting a conventional shopping/grocery bag and maintaining an openable mouth thereof in an open position, the bag being formed of a limp plastic material and provided with opposite loops for handles, the holder comprising a bracket in the form of an inverted U-shape, a base member connected to the bracket, two generally flat axially elongated extension arms for suspending and holding the bag in the open position, an array of first ribs for resisting flexure of the base member relative to the bracket, and a pair of Y-shaped second ribs for resisting flexure between the base member and said extension arms, the extension arms and base member being coplanar and having upper and lower surfaces and forming, a U-shaped holding frame, the extension arms having inner and outer edges and a free end and the base member and inner edges of the holding frame combining to form an outwardly open entry space for receiving the bag inserted therewithin, the outer edge of each extension arm having a pair of spaced-apart holding slots into which a respective loop of the plastic shopping/grocery bag is attached, each slot opening outwardly and facing away from the outwardly open space, the bracket including a forward facing surface generally at right angles to said upper surface and the bracket downwardly open for mounting over the top of standard door with the bag hanging in a generally vertical direction from the extensions or forming a hand grippable handle for carrying the bag in an upwardly open position to enable portability for picking up remote refuse for deposit in the open bag, each said first rib projecting upwardly, at least in part, from said upper surface and said forward surface and extending, at least in part, away from said forward facing surface, and each said Y-shaped second rib projecting from the lower surface of a respective extension arm and base member and including a first portion that extends axially between the holding slots and a second portion that branches off and extends transversely of the first portion.

6. A bag holder for supporting and holding open a flexible bag of the type having a pair of loop handles disposed on opposing sides of the bag and adjacent to an opening formed at an upper portion of the bag, comprising:

a handle for hanging on top of a cabinet door, a base fixedly connected to the inverted U-shaped handle, at least one L-shaped reinforcement rib for stiffening the connection between the U-shaped handle and the base and two mirror image arms fixedly cantilevered to the base and laterally spaced from one another to form with the base a U-shaped outwardly open space for receiving and supporting the upper end of the bag inserted therewithin, the arms being flat, coplanar with one another and, in use, generally horizontally disposed, the arms each provided with a pair of holding slots that engage a respective loop handle, the slots being axially spaced a suitable distance to hold the mouth of the flexible bag open for users to deposit household produced trash into the bag and oriented to be outwardly open and face away from the open space to receive the loops inserted therewithin, wherein the holding slots include a rearward slot proximate to the base and a forward slot proximate to the free end, the rearward slot being L-shaped and the forward slot being keyhole shaped.

7. The bag holder of claim 6, wherein the handle is in the form of an inverted U-shape for use in mounting atop and against the flat surface of a vertically disposed mounting member in a manner that the bag-supporting arms are substantially perpendicular to said mounting member and in a plane disposed substantially horizontally.

8. The bag holder of claim 6, wherein:

the extension arms and base form a U-shaped frame having generally planar U-shaped upper and lower surfaces and opposite lateral sides, the slots open outwardly relative to the lateral sides and forward end of each arm, at least one L-shaped rib further comprising a plurality of L-shaped reinforcement ribs, disposed in side-by-side relation, operate between the upper surface of the base and the handle, and a pair of Y-shaped reinforcement ribs are provided on the lower surface, one on each lateral side of the frame.

9. The bag holder of claim 8, wherein the Y-shaped ribs are associated with one and the other extension arm and each Y-shaped rib includes first and second rib members, the first rib member extending axially through the arm and between the two slots thereof and the second rib member extending transversely from the first rib member and across the base towards the handle.

* * * * *